US007033982B1

(12) United States Patent
Rager

(10) Patent No.: US 7,033,982 B1
(45) Date of Patent: Apr. 25, 2006

(54) METAL PRODUCT CLEANING COMPOSITION

(76) Inventor: Dolores J Rager Rager, 108 Fairview St., Brownsville, PA (US) 15417-9338

( * ) Notice: Subject to any disclaimer, the term of this patent is extended or adjusted under 35 U.S.C. 154(b) by 0 days.

(21) Appl. No.: 11/228,929

(22) Filed: Sep. 16, 2005

(51) Int. Cl.
*C11D 1/00* (2006.01)
*C11D 3/22* (2006.01)
*C11D 7/08* (2006.01)
*C11D 7/10* (2006.01)

(52) U.S. Cl. ..... 510/245; 510/249; 510/250; 510/253; 510/462; 510/474

(58) Field of Classification Search ..... 510/245, 510/249, 250, 253, 462, 474
See application file for complete search history.

(56) References Cited

U.S. PATENT DOCUMENTS 5,653,917 A * 8/1997 Singerman ..... 252/389.62
5,698,041 A 12/1997 Woo et al.
5,866,712 A 2/1999 Sanchez

* cited by examiner

*Primary Examiner*—Brian P. Mruk
(74) *Attorney, Agent, or Firm*—William Aylor; Dusty Gwinn

(57) ABSTRACT

A cleaning product comprising about 1% to 5% by weight cornstarch; about 17% to 27% by weight of an acid with a pH of about 2.5–3.5; about 52% to 62% by weight of a surfactant; about 7% to 17% by weight NaCl, wherein said cornstarch, said acid, said surfactant, and said NaCl are added together and heated to a slow bubbling boil and said cleaning composition appears smooth and milk-like in appearance and then heat reduced; and about 4% to 8% by weight oxalic acid dehydrate wherein said oxalic acid dehydrate is provided from the source manufactured under the tradename Barkeeper's Friend by SerVaas Laboratories of Indianapolis, Ind. and further wherein said compound is added after heat is reduced. The cleaning composition is useful for cleaning various types of metals.

9 Claims, No Drawings

METAL PRODUCT CLEANING COMPOSITION

CROSS-REFEREENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

Many common metal cleaners are ineffective or expensive. Common metal cleaners are often abrasive to the skin and have an unpleasant odor. This bare metal product is useful in the cleaning of household metals such as brass, copper, silver, and stainless steel while. The metal product cleaning composition also reduces the offensive odor and is less abrasive to the user. Additionally, the metal product cleaning composition has an increased efficiency requiring less scrubbing after application to remove oxidation.

BRIEF SUMMARY OF THE INVENTION

According to the invention, the metal product cleaning composition described is effective in cleaning many types of metals with an increased efficiency over other cleaners, and performs without the offensive odor while being less abrasive on the skin of the user. The metal product cleaning composition is comprised of about 1% to 5% by weight cornstarch; about 17% to 27% by weight of an acid with a pH of about 2.5–3.5; about 52% to 62% by weight of a surfactant; about 7% to 17% by weight NaCl, wherein said cornstarch, said acid, said surfactant and said NaCl are added together and heated to a slow boil and then heat reduced; and about 4% to 8% by weight oxalic acid.

BRIEF DESCRIPTION OF THE SEVERAL VEIWS OF THE DRAWING

Not Applicable

DETAILED DESCRIPTION OF THE INVENTION

The present invention contemplates an improved metal product cleaning composition resulting in a more efficient cleaning product with reduced offensive odor and less abrasiveness to the skin of the user. The preferred embodiment of the metal product composition comprises about 1% to 5% by weight cornstarch; about 17% to 27% by weight an acid of pH of about 2.5–3.5; about 52% to 62% by weight a surfactant; about 7% to 17% by weight NaCl, wherein said cornstarch, said acid, said surfactant, and said NaCl are added together, placed on a heating source and heated to a slow bubbling boil until said composition is smooth and milk-like in appearance; and about 4% to 8% by weight oxalic acid dehydrate, wherein the heat is reduced on said composition after the addition of said oxalic acid dehydreate and said composition is heated throughout and then said composition is removed from said heat source The preferred source for the oxalic acid is provided by the product manufactured under the tradename Barkeeper's Friend by SerVaas Laboratories of Indianapolis, Ind. The composition should be allowed to cool before using with agitation by shaking by the user before each use. Heating slowly keeps the formula from foaming and separating prior to the addition of the oxalic acid. Stirring often as the composition cools will increase the efficiency of the composition. However, if the composition is not stirred, it can be agitated by shaking before use to gain the increased efficiency.

The cleaning composition is heated to a slow bubbling boil until smooth and milk-like before the addition of the oxalic acid dihydrate to reduce foaming. A quick heating will cause the composition to foam over. The slow heating also reduces the fumes that are released as the composition heats an decreases separation within the composition.

The replacement of Barkeeper's Friend with other oxalic acid dihydrate containing products was less successful in yielding an efficient composition. Additionally, different temperatures and times of heating the composition were also unsuccessful in yielding an effective metal product cleaning composition.

The resulting composition can be applied to soiled and oxidized metal products that have not been lacquered or finished in any way. A pair of surgical gloves under a pair of soft white gloves may be used to remove the composition. After using the composition, water may be used to rinse while using the gloves to remove the composition to clean and rinse in an efficient manner. Abrasive scuff pads are not needed. Additionally, the composition may be stored for extended periods of time without losing efficiency in the ability to clean metal products so long as the composition is agitated by the user shaking the composition before use.

These terms and specifications serve to describe the invention by example and not to limit the invention. It is expected that others will perceive differences, which, while differing from the foregoing, do not depart from the scope of the invention herein described and claimed.

What is claimed is:

1. A metal cleaning mixture comprising:

about 1% to about 5% by weight cornstarch;

about 17% to about 27% by weight an acid of pH of about 2.5—to about 3.5;

about 52% to about 62% by weight a surfactant;

about 7% to about 17% by weight NaCl, wherein said cornstarch, said acid, said surfactant, and said NaCl are added together, placed on a heating source and heated to a slow bubbling boil until said mixture is smooth; and about 4% to about 8% by weight oxalic acid dihydrate, wherein the heat is reduced on said mixture after the addition of said oxalic acid dihydrate and said mixture is heated throughout and then said mixture is removed from said heat source.

2. The metal cleaning mixture of claim 1 wherein said mixture is agitated before use.

3. The metal cleaning mixture of claim 1 wherein said cornstarch is 3% by weight.

4. The metal cleaning mixture of claim 1 wherein said acid is 22% by weight.

5. The metal cleaning mixture of claim 1 wherein said surfactant is 57% by weight.

6. The metal cleaning mixture of claim 1 wherein said NaCl is 12% by weight.

7. The metal cleaning mixture of claim 1 wherein said oxalic acid dihydrate is 6% by weight.

8. The metal cleaning mixture of claim 1 wherein said acid is acetic acid.

9. The metal cleaning mixture of claim 1 wherein said acid is vinegar.

* * * * *